US005213431A

United States Patent [19]

Gentile et al.

[11] Patent Number: 5,213,431

[45] Date of Patent: May 25, 1993

[54] ROLL-ON DISPENSER WITH FLEXIBLE VALVE

[75] Inventors: James L. Gentile, Orange, Conn.; Joseph E. Meenan, Pleasantville, N.Y.

[73] Assignee: Chesebrough-Pond's USA Co., Division of Conopco, Inc., Greenwich, Conn.

[21] Appl. No.: 938,748

[22] Filed: Sep. 2, 1992

[51] Int. Cl.[5] ..... A45D 34/04

[52] U.S. Cl. ..... 401/219; 401/208; 401/213

[58] Field of Search ..... 401/208, 219, 213

[56] References Cited

U.S. PATENT DOCUMENTS

| | | | |
|---|---|---|---|
| 3,039,132 | 6/1962 | Hambley . | |
| 3,095,598 | 7/1963 | Gonnella . | |
| 3,134,131 | 5/1964 | Thomas . | |
| 3,235,900 | 2/1966 | Klassen . | |
| 3,263,265 | 8/1966 | Judson . | |
| 4,168,128 | 9/1979 | Fillmore . | |
| 4,723,860 | 2/1988 | Giblin . | |
| 4,909,265 | 3/1990 | Goncalves | 401/208 X |
| 5,026,193 | 6/1991 | Lucas | 401/208 X |
| 5,051,016 | 9/1991 | Bengston | 401/208 X |

FOREIGN PATENT DOCUMENTS 3829395 3/1989 Fed. Rep. of Germany .

*Primary Examiner*—Steven A. Bratlie

*Attorney, Agent, or Firm*—Milton L. Honig

[57] ABSTRACT

A dispensing device is provided including a container having a neck, a fitment mounted on the container having an elongated socket for receiving a roller therewithin and a valve member slidably mounted on the neck and communicating with an inner surface of the elongated socket. The valve member includes a transverse wall with a switch rib jutting outward from an upper surface thereof and projecting through a window formed on the wall of the fitment. A pair of slots flank the switch rib and partially traverse across the upper surface thereof and completely across a skirt projecting downwardly from the upper surface. Additionally, there may be a cutout area located between the slots. Both the slots and cutout area provide flexibility to the switch rib. Fluid communication between the container and fitment is achieved when a cap covering the fitment is removed. During removal, a projection on an inner surface of the cap catches the switch rib thereby moving the valve member upward and then through flexing of the switch rib disengaging same.

9 Claims, 5 Drawing Sheets

ROLL-ON DISPENSER WITH FLEXIBLE VALVE

BACKGROUND OF THE INVENTION

Field of the Invention

The invention relates to a roll-on dispenser package for distributing liquid formulations. A wide variety of liquid products may utilize this applicator package. These products are not limited to, but may include, adhesives, paints, stain removers, topical medicines and cosmetics. The latter category includes colognes, after-shave lotions, body lotions, sunscreens, suntan formulas and deodorant/antiperspirants. The applicator is particularly intended for the delivery of liquid deodorant/antiperspirants to underarm areas.

The Related Art

A considerable body of literature is available on oval or cylindrical roller dispensing packages. For instance, U.S. Pat. No. 3,039,132 (Hambley), U.S. Pat. No. 3,095,598 (Gonnella.et al), U.S. Pat. No. 3,134,131 (Thomas) and U.S. Pat. No. 4,168,128 (Fillmore et al) focus upon oval roller dispensing systems. A general problem with these systems is that of leakage of fluid product around the oval during storage. An attempt to solve the problem is reported in U.S. Pat. No. 4,723,860 (Giblin et al) which utilizes a spring-activated spud that controls flow through an aperture in the base of a socket holding the oval roller.

U.S. Pat. No. 3,263,265 (Judson) and U.S. Pat. No. 3,235,900 (Klassen) seek to solve the dispersion problem by providing serrations or circumferentially-spaced ribs, respectively, on the roller. While uptake of product onto the roller is improved thereby, the serrations or ribs interfere with a smooth deposition onto the surface to be coated. When the product is a deodorant/antiperspirant, there is the further detrimental effect of a non-smooth feel during product application.

Another problem of the art is the need for good distribution of product onto the oval wall. In U.S. Pat. No. 4,723,860 (Giblin et al), even distribution is achieved through use of a foam-spreading element within the socket.

A further set of patents describe wide roll-on mechanisms that include at least one switch on a flank of the package for controlling a valve allowing passage of fluid product between roller and container. The switches are activated by removal or placement of a cap over the dispenser. Examples of such mechanisms can be found in U.S. Pat. No. 5,051,016 (Bengston), U.S. Pat. No. 5,026,193 (Lucas) and German Patent 38 29 395 (L'Oreal). The switches in all of the aforementioned art are difficult to operate, especially through the capping action. For instance, intensive investigation of U.S. Pat. No. 5,026,193 found that in uncapping the dispenser, often the cap would stick onto the flip-up switch. Neither was it possible to achieve a positive, one-hand, one-step valve opening/closing with easy cap release. With regard to product application, there was also a problem in providing adequate spreading or dispersion of the fluid that exited the relatively small valve orifices.

Accordingly, it is an object of the present invention to provide a roll-on dispenser system whose fluid delivery valves are controlled by a switch outside the housing.

Another object of the present invention is to provide a roll-on dispenser with an outward valve control switch that can be activated by placement/removal of a covering cap.

A further object of the present invention is to provide a roll-on dispenser with an outward valve control switch that can be activated smoothly without sticking through removal/ replacement of a covering cap.

A still further object of the present invention is to provide a roll-on dispensing system wherein fluid product can be evenly spread and dispersed on an oval or cylindrical roller.

These and other objects of the present invention will become more evident through the following summary, examples and detailed description.

SUMMARY OF THE INVENTION

A dispensing device is disclosed comprising:

(i) a container having a neck;

(ii) a fitment mounted on the container, the fitment including an elongated socket with a cutout portion on an upper end thereof, a floor base forming a bottom of the socket with at least one aperture in the floor base, a pair of sidewalls opposite one another flanking the socket, a window in each of the side walls and a hollow sleeve formed on a rear surface of the floor base communicating with the aperture and projecting downward toward the container;

(iii) a roller mounted within the socket and having a short and a long axis; and (iv) a valve member mounted on the neck, vertically slidable perpendicular to the long axis between the neck and hollow sleeve and having means on the valve member allowing selective fluid communication therebetween, the valve member including an upper surface, a downwardly projecting skirt surrounding the upper surface along an edge thereof, a pair of switch ribs jutting outward from the upper surface in opposite directions from one another and each protrudable through a respective one of the windows, each of the switch ribs being flanked on either side thereof by a slot partially traversing across the upper surface and completely across the skirt.

Flexibility of the switch ribs is achieved through the aforementioned slots that flank either side of each switch rib. Additional flexibility is achieved through a cutout area located between the slots flanking one of the switch ribs. Sticking of the cap when uncovering the roller is thereby avoided through use of the slots and of the cutout area. Careful selection of the plastic material utilized for the switch rib also is important for imparting flexibility; polypropylene is especially useful.

Uniform spreading or dispersion of the fluid product is achieved through a series of ribs, preferably four or more running in a direction parallel to the long axis and protruding outward from the base floor of the socket.

BRIEF DESCRIPTION OF THE DRAWING

A preferred embodiment of the present invention will now be described by way of example with reference to the accompanying drawing in which.

DETAILED DESCRIPTION

Figure 1:
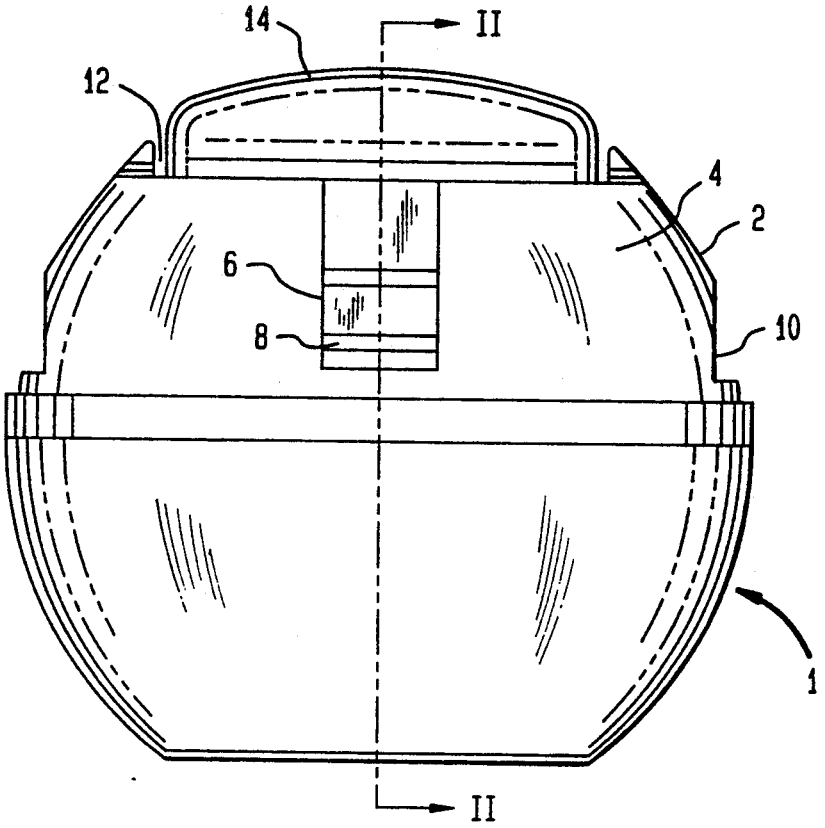
FIG. 1 is a front elevation view of the device according to the present invention.
Figure 3:
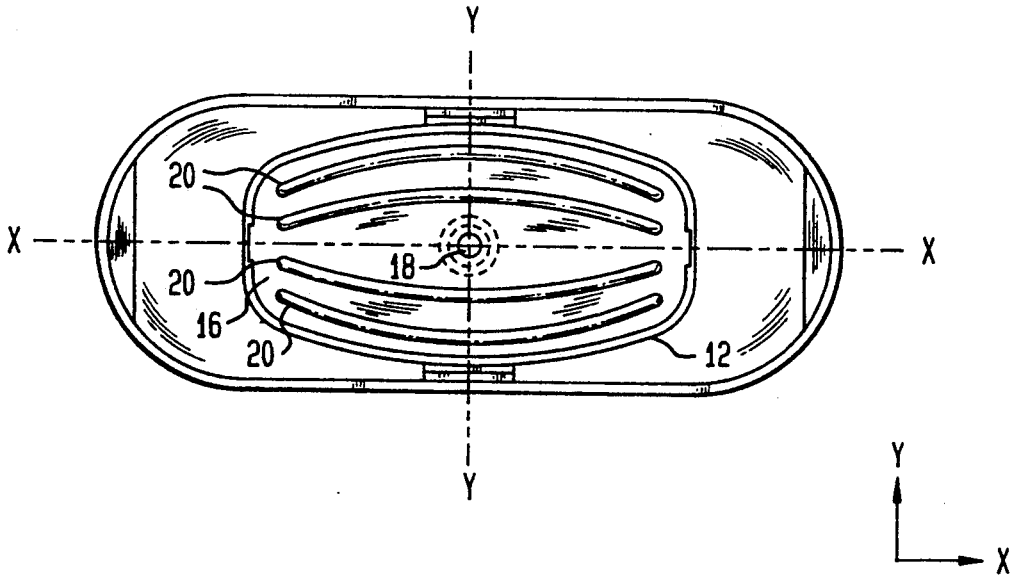
FIG. 3 is a top view looking down on the fitment (the roller being absent) of FIG. 1.

According to FIG. 1 there is shown a dispensing device that includes a container 1 housing a product intended to be dispensed and a fitment 2 mounted conformably on the container. Front and rear walls 4 of fitment 2 are each provided with a respective window 6 through which protrudes a switch rib 8 vertically movable therein. An L-shaped bevel 10 is formed at each end of fitment 2 flanked by front and rear walls 4. On an uppermost end of fitment 2 is formed an elongated socket 12. An oval or cylindrical roller 14 can be accommodated within socket 12. FIG. 3 provides a top view of fitment 2 wherein the roller has been removed. A floor base 16 forms a bottom of socket 12. At a central point in the floor base there is provided at least one aperture 18 capable of selectively communicating with the interior of container 1. A set of dispersing ribs 20 are formed as elongated ridges in floor base 16 aligned along a direction of the major axis X of roller 14. At least one set of dispersing ribs flanked on either side of aperture 18 have been found useful in spreading product outward from the aperture. Preferably there are at least two sets of dispersing ribs 20 within socket 12.

FIG. 2 provides a cross-sectional view of the dispensing device. This view depicts interior structures. Thus, container 1 includes a neck 22 at an upper end thereof.

A plug 24 covers neck 22 and is fixed by a retaining keeper 26 that engages with a groove 28 along an outer surface of neck 22. Plug 24 defines inside neck 22 a cylindrical socket 30 having a base 32 which is formed with orifices 34. Base 32 supports a closing finger 36.

A valve member 38 is slidably engaged on neck 22. Valve member 38 has a transverse wall 40 from which protrudes a downwardly projecting outer skirt 42, a downwardly projecting outer sealing wall 44 radially inward from skirt 42 and a downwardly projecting inner sealing wall 46 radially inward from wall 44. Protruding upwardly from transverse wall 40 is a sealing ring 48.

Figure 4:
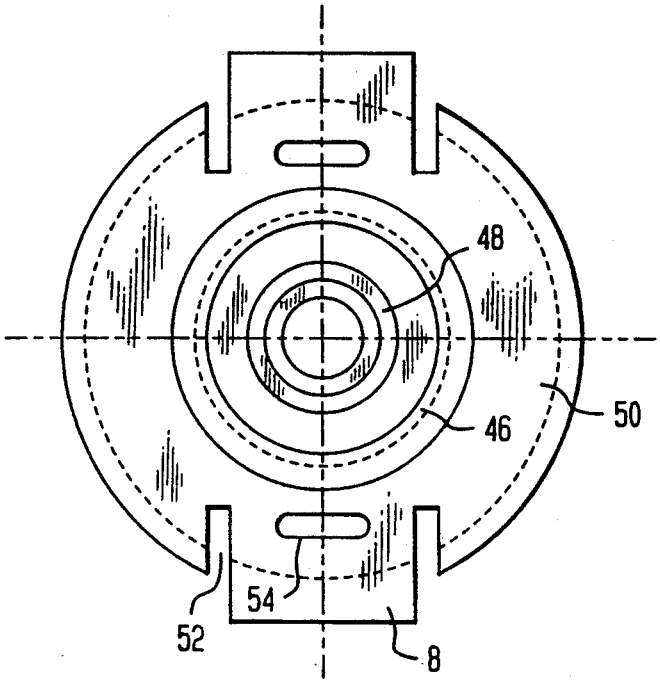
FIG. 4 is a top view of the valve member.
Figure 5:
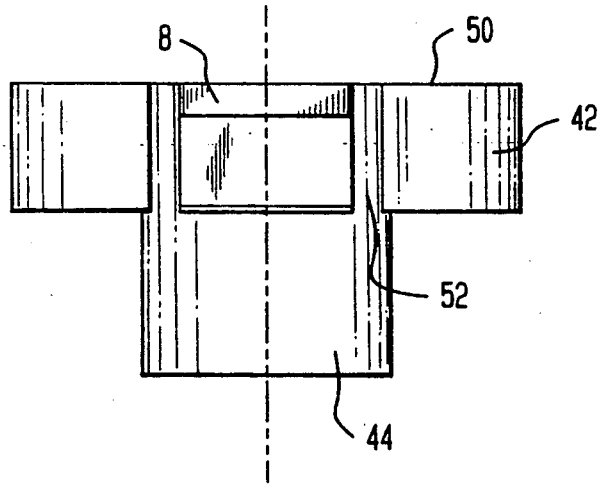
FIG. 5 is a side view of the valve member.
Figure 6:
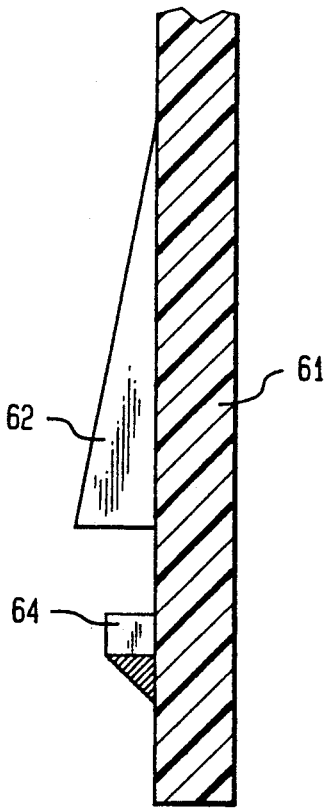
FIG. 6 is an exploded cross-sectional view of a bottom portion of the cap front wall.
Figure 7:
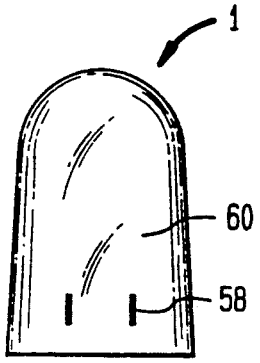
FIG. 7 is a cross-sectional view of the cap end wall.

FIGS. 4 and 5 provide top and front views of valve member 38. Jutting outward from upper surface 50 of transverse wall 40 are the two switch ribs 8 positioned 180° from one another. Flanking the sides of each switch rib 8 are a pair of parallel slots 52 that traverse partially across upper surface 50 and completely across the outer skirt 42. A cutout area 54 is positioned between each pair of slots 52. Both the cutout area and slots serve to render the switch rib 8 more flexible in its movability when actuated by cap 56. Prior valve members utilized for the dispensing device of this invention exhibited the very significant problem of the cap sticking onto the flip-up switch rib during attempts to uncover the roller. Advantageously, valve member 38 is best formed from polypropylene to assist flexibility. Prototypes formed of high density and low density polyethylene were each found to be inadequate; the polyethylene switch rib easily broke after only a short number of covering-uncovering actions of the cap.

Front and rear walls 4 of fitment 2 may be fixed by any convenient means to container 1 and the same applies to plug 24. On the other hand, valve member 38 is not fixed but rather must be capable of sliding along neck 22 so that the inner sealing wall 46 can act as a closing element in cooperation with closing finger 36. The outer sealing wall 44 also acts as a closing element in cooperation with wall 31 of the cylindrical socket 30.

Cap 56 will include four sets of retaining wings, two of the sets being end retaining wings 58 located on an inner surface of cap 56 on end walls 60 that join front and rear cap walls 61. Each of the end retaining wing 58 pairs will fit into the L-shaped bevel 10 of fitment 2 and function to prevent outward bulging of cap 56 thereby preventing activation of switch rib 8 under circumstances where the cap is attempted to be removed by grabbing at the ends thereof.

The other sets of wings identified as wedge-shaped overcap wings 62 are provided on an inner surface of each of the front and rear cap walls 61. Directly below and perpendicular to the overcap wings is an elongated projection 64 capable of interacting with switch rib 8 to movably activate therethrough the valve member 38. Operation of the dispensing device is shown through FIGS. 2*a* and 2*b*.

Figure 2A:
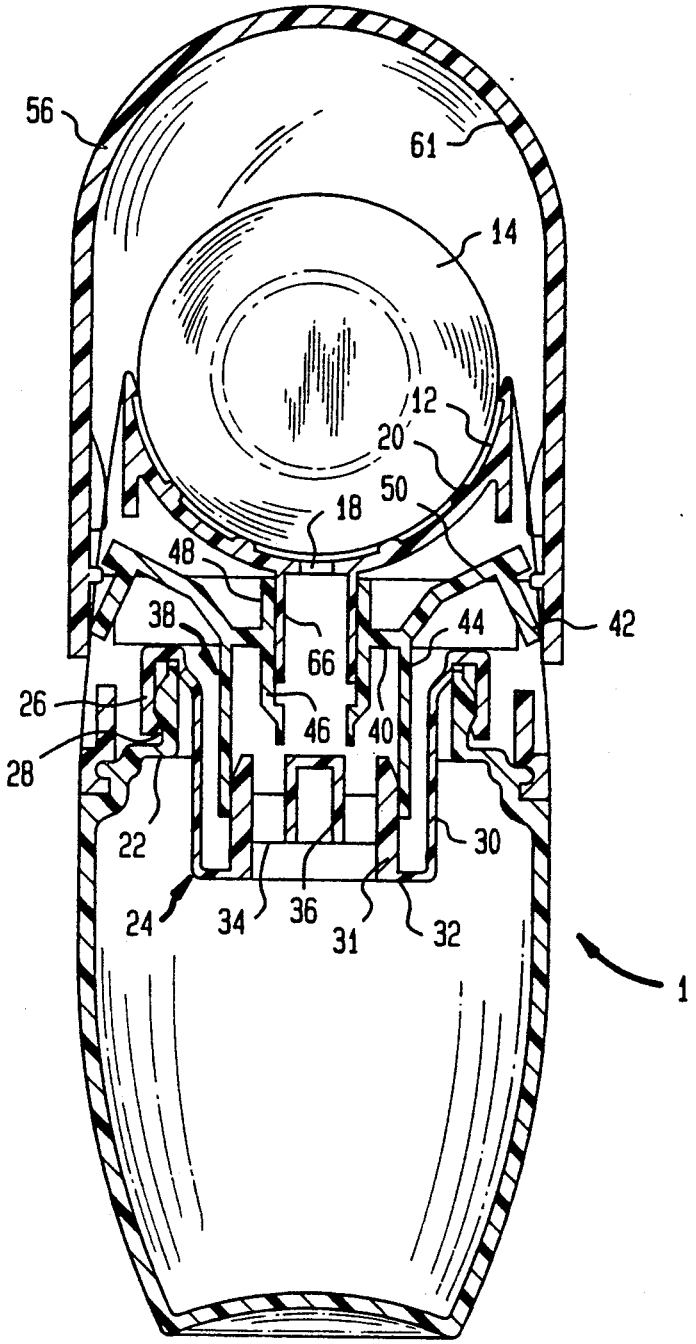
FIG. 2*a* is a cross-sectional view through the device taken along line II—II of FIG. 1 illustrating the cap partially off and the valve member in the flexing position prior to cap release.
Figure 2B:
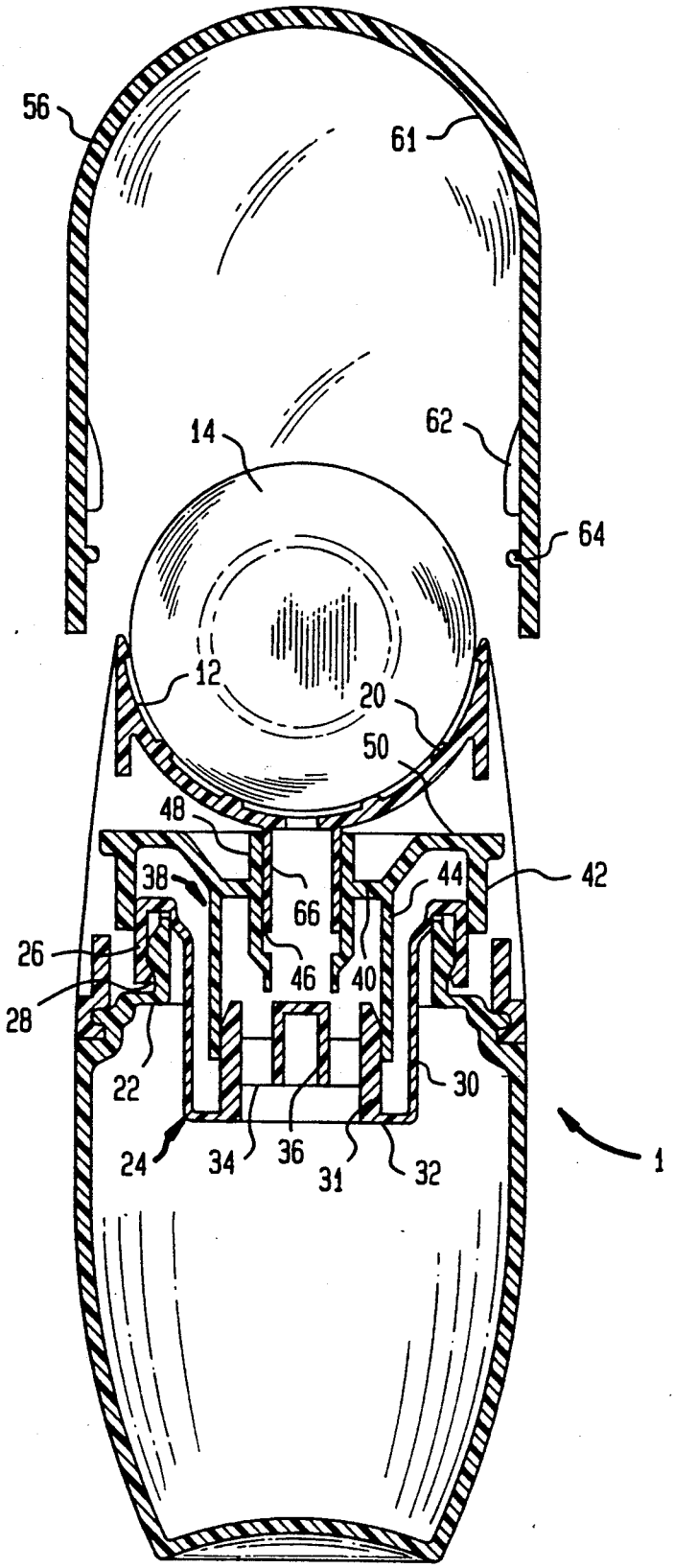
FIG. 2*b* is a cross-sectional view through the device also taken along line II—II of FIG. 1 illustrating the cap fully removed with the valve member now allowing communication between the roll-on socket and the fluid container.

In FIG. 2*a* there is shown the device with cap 56 partially being removed in an upward direction. Valve member 38 is drawn upwards from its closed position through catchment by the elongated projection 64 of cap 56 on an underside of switch rib 8. As cap 56 is moved upward the catchment causes switch rib 8 to flex until at some point the elongated projection 64 is free from engagement with switch rib 8. Once the switch rib 8 has been raised, fluid product can flow from container 1 through orifices 34 into sleeve member 66, protruding downward from an underside of socket 12 and then flow through aperture 18 into socket 12. Roller 14 with the aid of the dispersing ribs 20 will spread the fluid product outward from socket 12 for application onto a substrate. When the cap 56 is replaced over the dispensing package, projection 64 with the assistance of overcap wings 62 apply a downward force on switch rib 8 resulting in valve member 38 sliding downward. At some point thereafter the inner sealing wall 46 will encompass closing finger 36 and seal orifices 34.

It is to be understood that the invention in its broader aspect is not limited to the specific elements shown and described, but also includes within the scope of the accompanying claims any departures made from such elements which do not sacrifice its chief advantages.

What is claimed is:

1. A dispensing device comprising:

(i) a container having a neck;

(ii) a fitment mounted on the container, the fitment including an elongated socket with a cutout portion on an upper end thereof, a floor base forming a bottom of the socket with at least one aperture in the floor base, a pair of sidewalls opposite one another flanking the socket, a window in each of the side walls and a hollow sleeve formed on a rear surface of the floor base communicating with the aperture and projecting downward toward the container;

(iii) a roller mounted within the socket and having a short and a long axis; and (iv) a valve member mounted on the neck, vertically slidable perpendicular to the long axis between the neck and hollow sleeve and having means on the valve member allowing selective fluid communication therebetween, the valve member including an upper surface, a downwardly projecting skirt surrounding the upper surface along an edge thereof, a pair of switch ribs jutting outward from the upper surface in opposite directions from one another and each protrudable through a respective one of the windows, each of the switch ribs being flanked on either side thereof by a slot partially traversing across the upper surface and completely across the skirt.

2. A dispensing device according to claim 1 further comprising a cutout area located between the slots and flanking one of the switch ribs.

3. A dispensing device according to claim 1 wherein the valve member is formed from polypropylene.

4. A dispensing device according to claim 1 further comprising at least one dispersing rib on either side of the aperture, the dispersing rib being an elongated upward projection along the floor base of the socket oriented in a direction of the long axis.

5. A dispensing device according to claim 4 wherein at least two dispersing ribs are provided on either side of the aperture in the floor base.

6. A dispensing device according to claim 1 wherein the fitment at opposite ends thereof includes an L-shaped bevel.

7. A dispensing device according to claim 6 further comprising a cap for covering the fitment, the cap having front, rear and end walls, the end walls being flanked by the front and rear walls, and on an inner surface of each of the end walls there are present end retaining wings protruding inward which cooperatively seat on the L-shaped bevel.

8. A dispensing device according to claim 1 further comprising a cap for covering the fitment, the cap having front, rear and end walls, the end walls being flanked by the front and rear walls, and on an inner surface of each of the front and rear walls there is present a projection engageable with one of the switch ribs to thereby move the valve member upon emplacement over or removal of cap from dispensing device.

9. A dispensing device according to claim 8 further comprising a wedge-shaped overcap wing positioned on the inner surface of the cap directly above the projection that engages the switch rib.

* * * * *